US011074868B2

(12) United States Patent
Yuan et al.

(10) Patent No.: US 11,074,868 B2
(45) Date of Patent: Jul. 27, 2021

(54) PIXEL CIRCUIT, DISPLAY PANEL AND DISPLAY DEVICE

(71) Applicants: HEFEI BOE JOINT TECHNOLOGY CO., LTD., Hefei (CN); BOE TECHNOLOGY GROUP CO., LTD., Beijing (CN)

(72) Inventors: Zhidong Yuan, Beijing (CN); Yongqian Li, Beijing (CN); Can Yuan, Beijing (CN); Song Meng, Beijing (CN)

(73) Assignees: HEFEI BOE JOINT TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/823,680

(22) Filed: Mar. 19, 2020

(65) Prior Publication Data

US 2021/0049968 A1 Feb. 18, 2021

(30) Foreign Application Priority Data

Aug. 15, 2019 (CN) ..... 201910755665.6

(51) Int. Cl.
*G09G 3/325* (2016.01)
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2310/08* (2013.01)

(58) Field of Classification Search
CPC ..... G09G 2320/043; G09G 2320/0233; G09G 2320/045; G09G 2320/0295; G09G 3/3258; G09G 2300/0426; G09G 3/3291; G09G 2300/043; G09G 2300/0866; G09G 3/325; G09G 2310/0251; G09G 3/3241; G09G 2320/0242; G09G 2320/0626; G09G 2370/22; G09G 2300/0439
USPC ..... 345/76–78
See application file for complete search history.

(56) References Cited

U.S. PATENT DOCUMENTS 10,223,972 B1 * 3/2019 Kuang ..... G09G 3/3258
10,403,211 B2 * 9/2019 In ..... G09G 3/3233
2011/0279437 A1 11/2011 Komiya et al.
2015/0187276 A1 7/2015 Shim et al.
(Continued)

FOREIGN PATENT DOCUMENTS

CN 105225631 A 1/2016
CN 106486062 A 3/2017
(Continued)

OTHER PUBLICATIONS

First Chinese Office Action dated Jul. 3, 2020, for corresponding Chinese Application No. 201910755665.6.

*Primary Examiner* — Duc Q Dinh
(74) *Attorney, Agent, or Firm* — Kinney & Lange, P.A.

(57) ABSTRACT

Embodiments of the present disclosure provide a pixel circuit, a display panel, and a display device. The pixel circuit includes: a first transistor; a light emitting unit, a cathode being grounded; a second transistor; a third transistor; a fourth transistor; and a capacitor, a first terminal being coupled to the control electrode of the third transistor, and a second terminal being coupled to the second electrode of the third transistor.

16 Claims, 4 Drawing Sheets

(56) References Cited

U.S. PATENT DOCUMENTS

| | | | |
|---|---|---|---|
| 2015/0379939 | A1 | 12/2015 | Takasugi et al. |
| 2017/0061866 | A1 | 3/2017 | In et al. |
| 2019/0180693 | A1 | 1/2019 | Kim |
| 2019/0385535 | A1 | 12/2019 | In et al. |

FOREIGN PATENT DOCUMENTS

| | | | |
|---|---|---|---|
| CN | 108766349 | A | 11/2018 |
| CN | 108877650 | A | 11/2018 |
| CN | 109192142 | A | 1/2019 |
| CN | 109949748 | A | 6/2019 |
| CN | 109994078 | A | 7/2019 |
| EP | 3622503 | A1 | 3/2020 |

* cited by examiner

PIXEL CIRCUIT, DISPLAY PANEL AND DISPLAY DEVICE

CROSS-REFERENCE TO RELATED APPLICATION

This application claims priority of Chinese Patent Application No. 201910755665.6 filed on Aug. 15, 2019 in China National Intellectual Property Administration, the disclosure of which is incorporated herein by reference in entirety.

TECHNICAL FIELD

Embodiments of the present disclosure relate to the field of display technology, and in particular, to a pixel circuit, a display panel, and a display device.

BACKGROUND

AMOLED (Active-matrix organic light-emitting diode) display devices are expected to replace liquid crystal devices to become a mainstream choice for next-generation displays due to their high contrast, wide viewing angle, fast response speed and so on. Generally, in the design of pixel circuits for OLED (Organic Light-Emitting Diode) products, the pixel circuits are all made by using N-type TFTs (Thin Film Transistors) to meet process limitations. However, the OLED products themselves need electroluminescent devices to emit light, and the required light-emitting current needs to be provided by driving TFTs. Due to the differences in the driving TFTs, corrections need to be made through external compensation and shutdown compensation, therefore the design for the AMOLED display pixels needs to consider the compensation timing.

SUMMARY

According to a first aspect of the present disclosure, there is provided a pixel circuit, comprising:

a first transistor, a first electrode of the first transistor being coupled to a data line, and a control electrode of the first transistor being configured for inputting a first driving signal;

a light emitting unit, a cathode of the light emitting unit being grounded;

a second transistor, a first electrode of the second transistor being coupled to an anode of the light emitting unit, a second electrode of the second transistor being grounded, and a control electrode of the second transistor being configured for inputting the first driving signal;

a third transistor, a first electrode of the third transistor being coupled to a DC power supply, a second electrode of the third transistor being coupled to the anode of the light emitting unit, and a control electrode of the third transistor being coupled to a second electrode of the first transistor;

a fourth transistor, a first electrode of the fourth transistor being coupled to the data line, a second electrode of the fourth transistor being coupled to the anode of the light emitting unit, and a control electrode of the fourth transistor being configured for inputting a second driving signal; and a capacitor, a first terminal of the capacitor being coupled to the control electrode of the third transistor, and a second terminal of the capacitor being coupled to the second electrode of the third transistor.

According to some embodiments of the present disclosure, the pixel circuit does not comprise a sensing line.

According to some embodiments of the present disclosure, the light emitting unit is powered through the third transistor, and the pixel circuit is configured to sense a voltage of the second electrode of the third transistor.

According to some embodiments of the present disclosure, a switch is provided in the data line, and the switch is configured to be coupled to an analog-to-digital converter.

According to some embodiments of the present disclosure, a driving phase comprises a scan period and a sense period, and during the sense period, a voltage of the second electrode of the third transistor is sensed only for a selected row of pixels.

According to some embodiments of the present disclosure, in the driving phase, when a row of pixels in which a target pixel is located is selected, the second driving signal is at a first level within a first set time period in the sense period to drive the fourth transistor to be turned on, wherein the first level is a high level.

According to some embodiments of the present disclosure, in the driving phase, the first driving signal is at the first level within a second set time period in the scan period to drive the first transistor and the second transistor to be turned on, and when the row of pixels in which the target pixel is located is selected, the first driving signal is at the first level within a third set time period and a fourth set time period in the sense period, wherein the first set time period is located between the third set time period and the fourth set time period.

According to some embodiments of the present disclosure, in a shutdown compensation phase, the second driving signal is at a second level to drive the fourth transistor to be turned off, wherein the second level is a low level.

According to some embodiments of the present disclosure, in the shutdown compensation phase, when the row of pixels in which the target pixel is located is selected, the first driving signal is at the first level to drive the first transistor and the second transistor to be turned on, wherein the first level is a high level.

According to some embodiments of the present disclosure, the light emitting unit is an organic light emitting diode or an active matrix organic light emitting diode.

According to some embodiments of the present disclosure, the first transistor, the second transistor, the third transistor, and the fourth transistor are thin film transistors.

According to some embodiments of the present disclosure, the first transistor, the second transistor, the third transistor, and the fourth transistor are N-type transistors.

According to some embodiments of the present disclosure, a driving phase comprises a scan period and a sense period, and during the sense period, a voltage of the second electrode of the third transistor is sensed only for a selected row of pixels.

According to some embodiments of the present disclosure, in the driving phase, when a row of pixels in which a target pixel is located is selected, the second driving signal is at a first level within a first set time period in the sense period to drive the fourth transistor to be turned on, wherein the first level is a high level.

According to some embodiments of the present disclosure, in the driving phase, the first driving signal is at the first level within a second set time period in the scan period to drive the first transistor and the second transistor to be turned on, and when the row of pixels in which the target pixel is located is selected, the first driving signal is at the first level within a third set time period and a fourth set time period in the sense period, wherein the first set time period is located between the third set time period and the fourth set time period.

According to some embodiments of the present disclosure, in a shutdown compensation phase, the second driving signal is at a second level to drive the fourth transistor to be turned off, wherein the second level is a low level.

According to some embodiments of the present disclosure, in the shutdown compensation phase, when the row of pixels in which the target pixel is located is selected, the first driving signal is at the first level to drive the first transistor and the second transistor to be turned on.

According to a second aspect of the present disclosure, there is provided a display panel, comprising the pixel circuit according to any one of the embodiments in the first aspect.

According to a third aspect of the present disclosure, there is provided a display device, comprising a housing and the display panel according to any one of the embodiments in the second aspect.

BRIEF DESCRIPTION OF THE DRAWINGS

The above and/or additional aspects and advantages of the present disclosure will be apparent and easily understood from the following description of the embodiments in combination with the accompanying drawings, in the drawings.

DETAILED DESCRIPTION OF EMBODIMENTS

Figure 1:
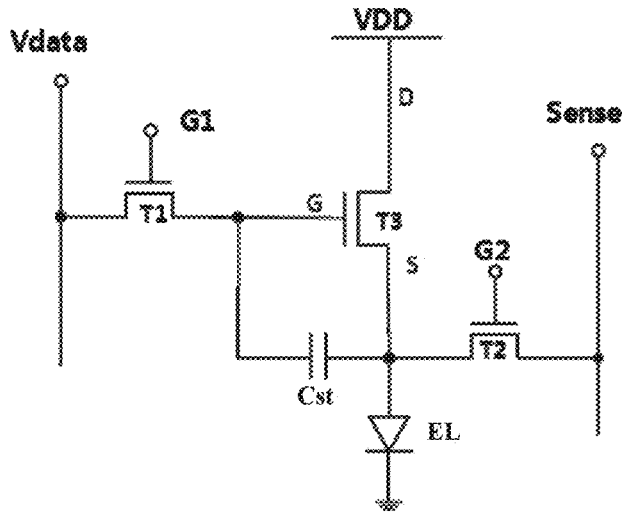
FIG. 1 is a schematic structural view of a pixel circuit in the related art.

Hereinafter, embodiments of the present disclosure will be described in detail, and the examples of the embodiments are shown in the accompanying drawings. The same or similar reference numerals represent the same or similar elements or elements having the same or similar functions throughout the specification of the present application. The embodiments described below with reference to the drawings are exemplary, and are intended to explain the present disclosure, but they should not be construed as limiting the present disclosure.

In the design of pixel circuits for OLED (Organic Light-Emitting Diode) products, the pixel circuits are all made by using N-type TFTs (Thin Film Transistors) to meet process limitations. For example, in a design of a 54.5 inch AMOLED display panel, a 3T1C circuit shown in FIG. 1 is adopted, wherein T1-T3 represent first to third transistors respectively, Vdata is a data line, VDD is a DC power supply, Sense represents a sensing line, EL is a light emitting unit, G1 is a first driving signal, G2 is a second driving signal, and Cst is a capacitor. However, the OLED products themselves need electroluminescent devices to emit light, and the required light-emitting current needs to be provided by a driving TFT (T3). Due to the differences in the driving TFTs, corrections need to be made through external compensation and shutdown compensation, therefore the design for the AMOLED display pixels needs to consider the compensation timing.

In the related art, as shown in FIG. 1, it is necessary to provide a special sensing line "Sense" to sense the voltage at the node S (source electrode) of the third transistor T3, to perform voltage compensation on the driving TFT. In this way, it causes the circuit board of the pixel circuit to have too much wiring, which is unbeneficial to a high PPI (Pixels Per Inch) display. Moreover, the driving signals G1 and G2 need to be scanned row by row during the scan period, it results in an excessively large area occupied by the pixel circuit (double driving signals are required), and it is unbeneficial to a narrow bezel design of the product and has a high cost.

Figure 2:
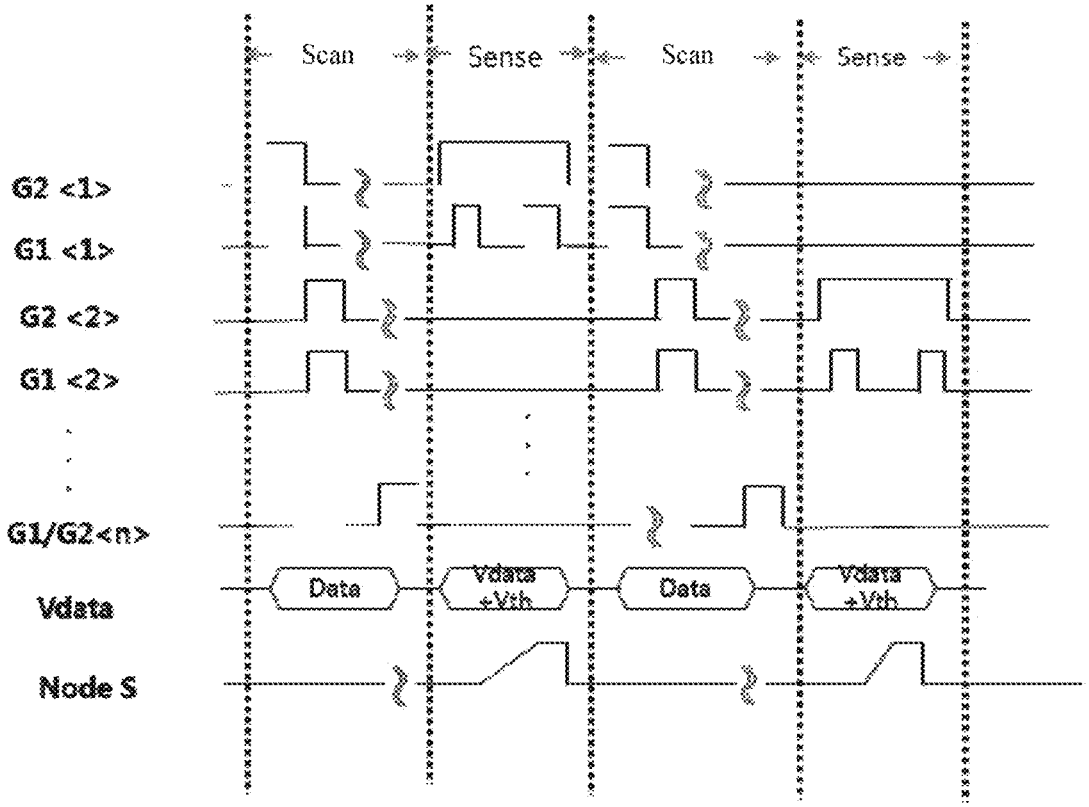
FIG. 2 is a timing diagram of the pixel circuit shown in FIG. 1.

The embodiments of the present disclosure are made by designers based on their knowledge and research on the following issues: in the related art, a 3T1C circuit is generally used in the pixel circuit, as shown in FIG. 1, due to the differences in the driving TFTs, corrections need to be made through external compensation and shutdown compensation, therefore the design for the AMOLED display pixels needs to consider the compensation timing. A sensing line "Sense" is required to sense the voltage at the node S, to perform voltage compensation on the driving TFT. FIG. 2 is a compensation timing diagram of the pixel circuit shown in FIG. 1, and FIG. 3 is a shutdown compensation timing diagram of the pixel circuit shown in FIG. 1.

Figure 3:
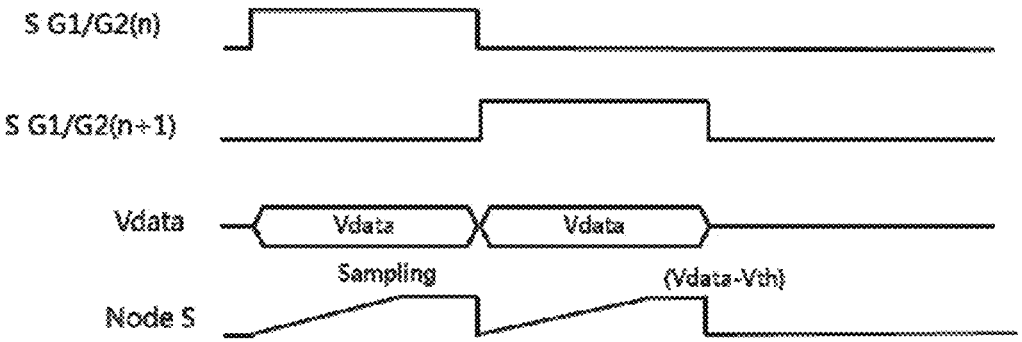
FIG. 3 is a shutdown compensation timing diagram of the pixel circuit shown in FIG. 1.

As can be seen from FIG. 2 and FIGS. 3, G1 and G2 both need to be scanned row by row during the scan period, it results in an excessively large area occupied by the pixel circuit (double driving signals are required), and it is unbeneficial to a narrow bezel design of the product and has a high cost. Moreover, the sensing line causes the circuit board of the pixel circuit to have too much wiring, which is unbeneficial to a high PPI display.

The embodiments of the present disclosure are intended to solve one of the technical problems in the related art at least to a certain extent.

In this regard, the first object of the embodiments of the present disclosure is to provide a pixel circuit, which does not need to be specifically provided with a sensing line, and can complete voltage compensation by using a data line. It is suitable for high PPI display, and it is only necessary for the fourth transistor to be turned on to implement voltage compensation during the sense period when a row of pixels in which a target pixel is located is selected, there is no need to perform a row-by-row design for the driving signal of the fourth transistor. In this way, it greatly reduces the layout space occupied by the pixel circuit, thus it can not only achieve narrow bezel of product, but also reduce costs.

A second object of the embodiments of the present disclosure is to provide a display panel.

A third object of the embodiments of the present disclosure is to provide a display device.

Hereinafter, a pixel circuit, a display panel, and a display device according to the embodiments of the present disclosure will be described with reference to the drawings.

Figure 4:
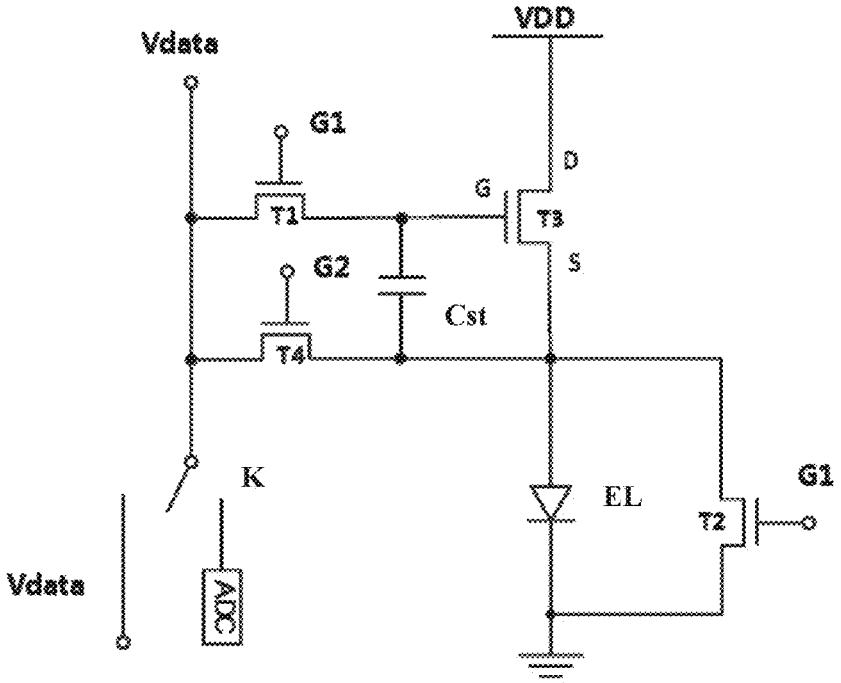
FIG. 4 is a structural view of a pixel circuit according to an embodiment of the present disclosure.

FIG. 4 is a structural view of a pixel circuit according to an embodiment of the present disclosure. As shown in FIG. 4, the circuit includes a first transistor T1, a light emitting unit EL, a second transistor T2, a third transistor T3, a fourth transistor T4, and a capacitor Cst.

A first electrode of the first transistor T1 is coupled to a data line Vdata, a control electrode of the first transistor T1 is configured for inputting a first driving signal G1. A cathode of the light emitting unit EL is grounded. A first electrode of the second transistor T2 is coupled to an anode of the light emitting unit EL, a second electrode of the second transistor T2 is grounded, and a control electrode of the second transistor T2 is configured for inputting the first driving signal G1. A first electrode of the third transistor T3 is coupled to a DC power supply VDD, a second electrode of the third transistor T3 is coupled to the anode of the light emitting unit EL, and a control electrode of the third transistor T3 is coupled to a second electrode of the first transistor T1. A first electrode of the fourth transistor T4 is coupled to the data line Vdata, a second electrode of the fourth transistor T4 is coupled to the anode of the light emitting unit EL, and a control electrode of the fourth transistor T4 is configured for inputting a second driving signal G2. A first terminal of the capacitor Cst is coupled to the control electrode of the third transistor T3, and a second terminal of the capacitor Cst is coupled to the second electrode of the third transistor T3.

It should be noted that, in the embodiments of the present disclosure, the first transistor T1, the second transistor T2, the third transistor T3, and the fourth transistor T4 may be thin film transistors (TFTs), the first transistor T1, the second transistor T2, the third transistor T3, and the fourth transistor T4 may be N-type transistors, and the first level 1 is a high level. The light emitting unit EL may be an organic light emitting diode (OLED) or an active matrix organic light emitting diode (AMOLED).

Figure 5:
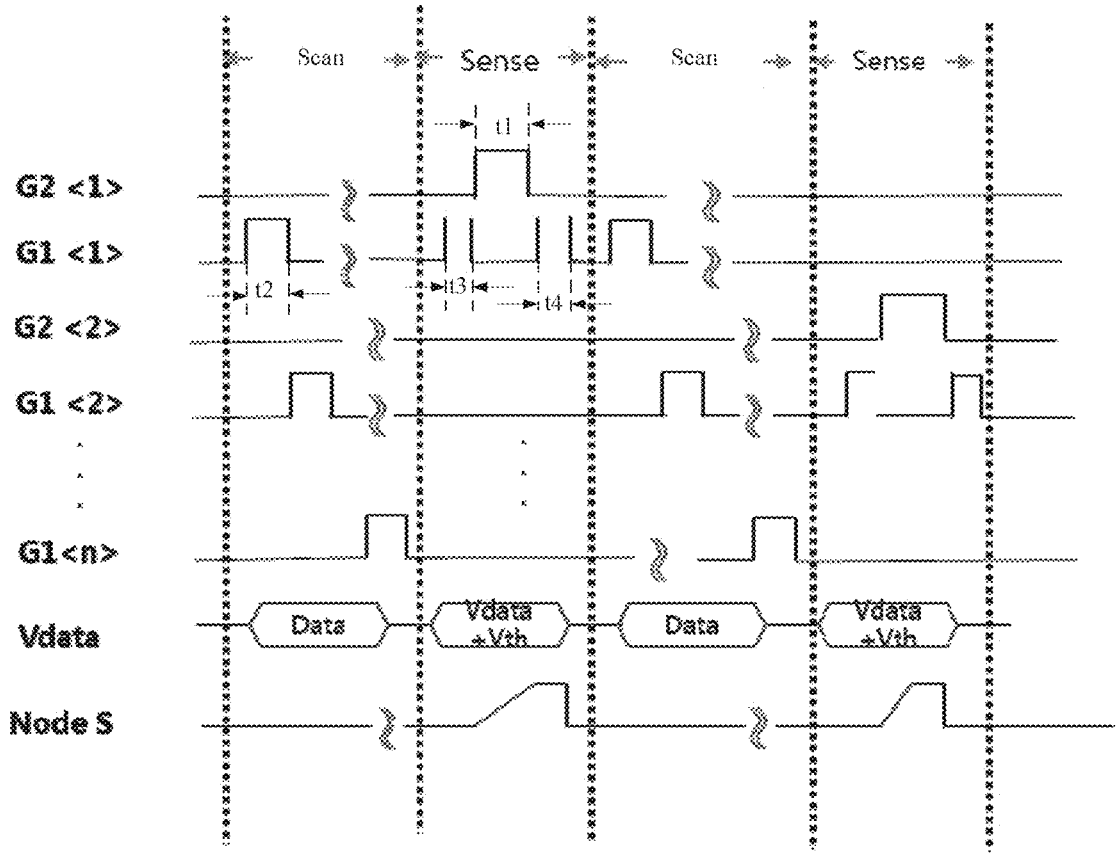
FIG. 5 is a timing diagram of the pixel circuit shown in FIG. 4.

Specifically, as shown in FIG. 4, it is necessary to introduce an auxiliary cathode for a light emitting unit with a top emission structure. Generally, the auxiliary cathode is made on an array substrate. In the embodiments of the present disclosure, the auxiliary cathode is directly used for reset operation, so that the structural implementation of the present disclosure is relatively simple. In the embodiments of the present disclosure, it is not necessary to provide a special sensing line, the voltage at the node S (source electrode) of the third transistor T3 may be sensed only by connecting the switch K to an ADC (Analog-to-Digital Converter), so that a voltage compensation may be implemented to the driving TFT (T3) according to the voltage. In this way, it is suitable for high PPI display, and the switch K is coupled to Vdata to complete the reset operation. In addition, in the embodiments of the present disclosure, the G2 timing is separated out, G1 is used to control T1 and T2, G2 is used to control T4, the timing diagram may refer to FIG. 5. As shown in FIG. 5, the driving phase may be divided into a scan period and a sense period. During the sense period, a certain row is randomly selected for sensing (sensing lines "Sense" are shown in order, to facilitate understanding of FIG. 5). The driving signal G2 only needs one clock (CLK) to control T4 to be turned on, and sense the voltage of the node S. Specifically, a sampling resistor, a sampling capacitor, and an analog-to-digital converter can be used for voltage sensing to perform voltage compensation. There is no need to perform a row-by-row design for the driving signal of the fourth transistor. In this way, it greatly reduces the layout space occupied by the pixel circuit, thus it can not only achieve narrow bezel of product, but also reduce costs. The sense of the voltage of the node S may be performed by using known means, and it will not be described in detail.

According to an embodiment of the present disclosure, as shown in FIG. 5, in the driving phase, when a row of pixels in which a target pixel is located is selected, the second driving signal G2 is at a first level within a first set time period t1 in the sense period to drive the fourth transistor T4 to be turned on.

Further, according to an embodiment of the present disclosure, as shown in FIG. 5, in the driving phase, the first driving signal G1 is at the first level 1 within a second set time period t2 in the scan period to drive the first transistor T1 and the second transistor T2 to be turned on, and when the row of pixels in which the target pixel is located is selected, the first driving signal G1 is at the first level 1 within a third set time period t3 and a fourth set time period t4 in the sense period, wherein the first set time period t1 is located between the third set time period t3 and the fourth set time period t4.

Specifically, as shown in FIG. 5, the driving phase is divided into a scan period and a sense period.

During the scan period, G2 is always at a low level, G1 is turned on for the time period t2 to be turned on T1 and T2, and read compensation data;

During the sense period, a certain row is randomly selected for sensing. The process is performed in three phases:

The first phase (t3): G1 is at a high level for the row, G2 is made at a low level to control T1 and T2 to be turned on and read the compensation data;

The second phase (t1): G1 is at a low level, G2 is made at a high level to control T4 to be turned on and perform sensing;

The third phase (t4): after the sensing is completed, G2 is made at a low level and G1 is made at a high level to control T1 and T2 to be turned on and write back to the data again.

Figure 6:
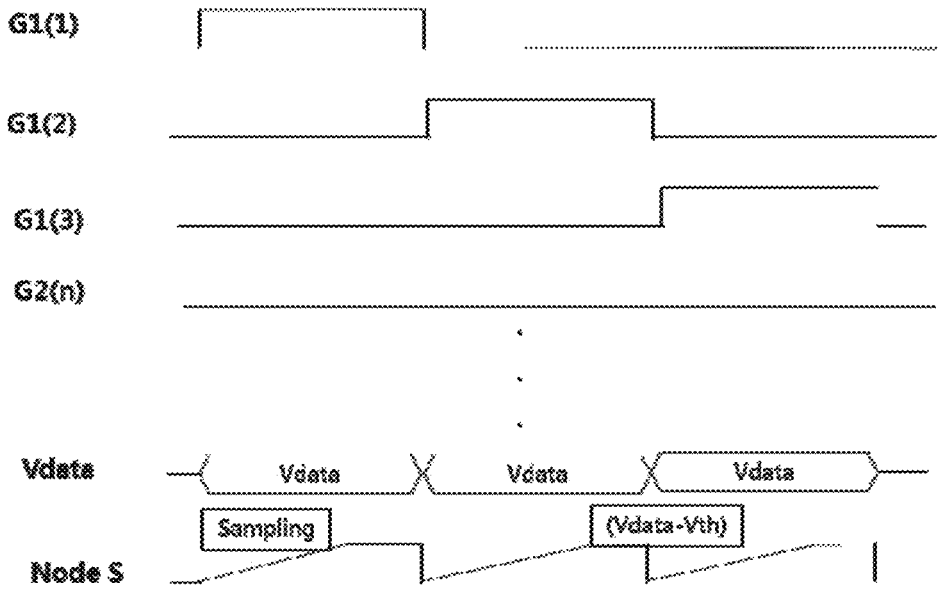
FIG. 6 is a shutdown compensation timing diagram of the pixel circuit shown in FIG. 4.

Further, in an embodiment of the present disclosure, FIG. 6 is a shutdown compensation timing diagram of the pixel circuit shown in FIG. 4. As shown in FIG. 6, during the shutdown compensation phase, the second driving signal G2 is at a second level 0 to turn off the fourth transistor T4. During the shutdown compensation phase, the first driving signal G1 is made at a first level 1 when the row of pixels in which the target pixel is located is selected, to drive the first transistor T1 and the second transistor T2 to be turned on.

Specifically, as shown in FIG. 6, during the shutdown compensation phase, G2 is always at a low level to keep T4 always off, and the first driving signal G1 is made at a first level 1 when the row of pixels in which the target pixel is located is selected, to drive the first transistor T1 and the second transistor T2 to be turned on, and to read the compensation data.

Figure 7:
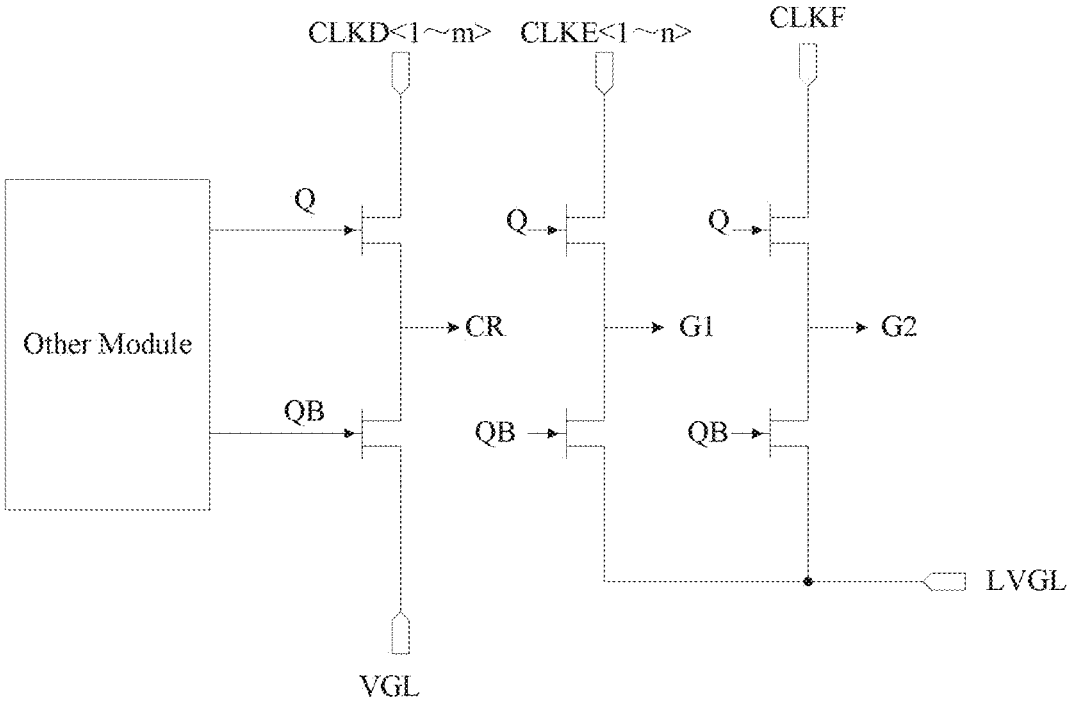
FIG. 7 is a schematic view of driving signals of the pixel circuit shown in FIG. 4.

It should be understood that the design of the driving circuit required by the pixel circuit according to the embodiments of the present disclosure may be made in such a way that the conventional n driving signals G1 and n driving signals G2 (n is a natural number greater than or equal to 2) may be reduced to n driving signals G1 and one driving signal G2, as shown in FIG. 7, which is a schematic view of driving signals of the pixel circuit shown in FIG. 4, it shows a possible GOA (Gate Driver on Array) circuit architecture, where the driving signal G1 is a signal for writing data/gate lines during the scan period (T1 and T2 in FIG. 4), and the driving signal G2 is a signal for driving gate lines during the sense period (T4). Only one row is turned on per frame during the sense period, therefore it does not need multiple CLKFs, and only one CLKF is needed. During the scan period, the GOA circuit needs to be cascaded, therefore multiple CLKEs are required. It can be seen from FIG. 7 that the layout space occupied by the GOA circuit architecture is reduced (the number of CLKFs is reduced to one), thus it can not only achieve narrow bezel of product, but also reduce costs.

To sum up, in the pixel circuit according to the embodiments of the present disclosure, a fourth transistor is added, meanwhile a first driving signal is used to control the first transistor and the second transistor, and a second driving signal is used to control the fourth transistor. Thus, it does not need to specifically provide a sensing line, and can complete voltage compensation by using a data line. It is suitable for high PPI display, and it is only necessary for the fourth transistor to be turned on to implement voltage compensation during the sense period when a row of pixels in which a target pixel is located is selected, there is no need to perform a row-by-row design for the driving signal of the fourth transistor. In this way, it greatly reduces the layout space occupied by the pixel circuit, thus it can not only achieve narrow bezel of product, but also reduce costs.

An embodiment of the present disclosure further provides a display panel including the above-mentioned pixel circuit.

According to the display panel provided by the embodiments of the present disclosure, by means of the above-mentioned pixel circuit, it does not need to specifically provide a sensing line, and can complete voltage compensation by using a data line. It is suitable for high PPI display, and it can greatly reduce the layout space occupied by the pixel circuit, thus it can not only achieve narrow bezel of product, but also reduce costs.

An embodiment of the present disclosure further provides a display device including the above-mentioned display panel.

According to the display device provided by the embodiments of the present disclosure, by means of the above-mentioned display panel, it does not need to specifically provide a sensing line, and can complete voltage compensation by using a data line. It is suitable for high PPI display, and it can greatly reduce the layout space occupied by the pixel circuit, thus it can not only achieve narrow bezel of product, but also reduce costs.

In the description of this specification, the description with reference to the terms "an embodiment", "some embodiments", "an example", "a specific example", "some examples" and the like mean the specific feature, structure, material, or characteristic described in conjunction with the embodiment(s) or example(s) is included in at least one embodiment or example of the present disclosure. In this specification, the schematic expressions referring to the above terms are not necessarily directed to the same embodiment or example. Moreover, the specific feature, structure, material, or characteristic described may be combined in any suitable manner in any one or more embodiments or examples. In addition, different embodiments or examples and features of the different embodiments or examples described in this specification may be combined or incorporated with each other by those skilled in the art, as long as it does not incur mutual contradiction.

In addition, the terms "first", "second" are only used for descriptive purposes, but should not be understood as indicating or implying relative importance or implicitly indicating the number of technical features indicated. Therefore, the features defined by "first", "second" may explicitly or implicitly include at least one of the features. In the description of the present disclosure, the meaning of "a plurality of" refers to at least two, for example, two, three, etc., unless it is specifically defined otherwise.

Any process or method description in a flowchart or otherwise described herein should be interpreted as representing a module, section, or portion of code that includes one or more executable instructions for implementing steps of a custom logic function or process, and the scope of optional implementations of the present disclosure includes additional implementations in which the function may be performed out of the order shown or discussed, for example, it is performed in a substantially simultaneous manner or in a reverse order according to the function involved, which should be understood by those skilled in the art to which the embodiments of the present disclosure belong.

Logic and/or steps represented in a flowchart or otherwise described herein, for example, a sequenced list of executable instructions that may be considered to implement a logical function, may be embodied in any computer-readable medium, for use by an instruction execution system, device, or apparatus (for example, a computer-based system, a system including a processor, or other systems that can read and execute instructions from an instruction execution system, device, or apparatus), or in connection with such an instruction execution system, device, or apparatus. For this specification, a "computer-readable medium" may be any device that can contain, store, communicate, propagate, or transmit a program for use by or in connection with an instruction execution system, device, or apparatus. More specific examples (non-exhaustive list) of the computer-readable medium include the following: an electrical connection (electronic device) with one or more wirings, a portable computer disk (magnetic device), a random access memory (RAM), a read-only memory (ROM), an erasable and editable read-only memory (EPROM or flash memory), a fiber optic device, and a portable compact disk read-only memory (CDROM). In addition, the computer-readable medium may even be paper or other suitable medium on which the program can be printed, because, for example, by optically scanning the paper or other medium, followed by edition, interpretation, or other suitable processes, the program may be obtained in an electronic manner, and then stored in a computer memory.

It should be understood that portions of the present disclosure may be implemented in hardware, software, firmware, or a combination thereof. In the above embodiments, multiple steps or methods may be implemented by software or firmware stored in a memory and executed by a suitable instruction execution system. For example, if implemented in hardware, it may be implemented by using any one or a combination of the following techniques known in the art: a discrete logic circuit with logic gate circuits for implementing logic functions on data signals, an application-specific integrated circuit with suitable combinational logic gate circuits, a programmable gate array (PGA), a field programmable gate array (FPGA), etc.

It should be understood by those skilled in the art that all or part of the steps in the methods according to the foregoing embodiments can be implemented by a program instructing related hardware. The program can be stored in a computer-readable storage medium and includes one or a combination of the steps of the method embodiment when the program is executed.

In addition, various functional units in each embodiment of the present disclosure may be integrated into one processing module, or various units may exist separately physically, or two or more units may be integrated into one module. The above integrated modules may be implemented in the form of a hardware or a software functional module. If the integrated module is implemented in the form of a software functional module and sold or used as an independent product, it may also be stored in a computer-readable storage medium.

The aforementioned storage medium may be a read-only memory, a magnetic disk, or an optical disk. Although the embodiments of the present disclosure have been shown and described above, it should be understood that the above embodiments are exemplary and should not be construed as limitations on the present disclosure. Change, modification, substitution and variation may be made to the embodiments of the present disclosure by those skilled in the art within the scope of the present disclosure.

What is claimed is:

1. A pixel circuit, comprising:

a first transistor, a first electrode of the first transistor being coupled to a data line, and a control electrode of the first transistor being configured for inputting a first driving signal;

a light emitting unit, a cathode of the light emitting unit being grounded;

a second transistor, a first electrode of the second transistor being coupled to an anode of the light emitting unit, a second electrode of the second transistor being grounded, and a control electrode of the second transistor being configured for inputting the first driving signal;

a third transistor, a first electrode of the third transistor being coupled to a DC power supply, a second electrode of the third transistor being coupled to the anode of the light emitting unit, and a control electrode of the third transistor being coupled to a second electrode of the first transistor;

a fourth transistor, a first electrode of the fourth transistor being coupled to the data line, a second electrode of the fourth transistor being coupled to the anode of the light emitting unit, and a control electrode of the fourth transistor being configured for inputting a second driving signal; and a capacitor, a first terminal of the capacitor being coupled to the control electrode of the third transistor, and a second terminal of the capacitor being coupled to the second electrode of the third transistor, wherein a driving phase comprises a scan period and a sense period, and during the sense period, a voltage of the second electrode of the third transistor is sensed only for a selected row of pixels, wherein in the driving phase, when a row of pixels in which a target pixel is located is selected, the second driving signal is at a first level within a first set time period in the sense period to drive the fourth transistor to be turned on, wherein the first level is a high level, and wherein, in the driving phase, the first driving signal is at the first level within a second set time period in the scan period to drive the first transistor and the second transistor to be turned on, and when the row of pixels in which the target pixel is located is selected, the first driving signal is at the first level within a third set time period and a fourth set time period in the sense period, wherein the first set time period is located between the third set time period and the fourth set time period.

2. The pixel circuit according to claim 1, wherein the pixel circuit does not comprise a sensing line.

3. The pixel circuit according to claim 2, wherein the light emitting unit is powered through the third transistor, and the pixel circuit is configured to sense a voltage of the second electrode of the third transistor.

4. The pixel circuit according to claim 3, wherein a switch is provided in the data line, and the switch is configured to be coupled to an analog-to-digital converter.

5. The pixel circuit according to claim 4, configured such that a driving phase comprises a scan period and a sense period, and during the sense period, a voltage of the second electrode of the third transistor is sensed only for a selected row of pixels.

6. The pixel circuit according to claim 5, wherein, in the driving phase, when a row of pixels in which a target pixel is located is selected, the second driving signal is at a first level within a first set time period in the sense period to drive the fourth transistor to be turned on, wherein the first level is a high level.

7. The pixel circuit according to claim 6, wherein, in the driving phase, the first driving signal is at the first level within a second set time period in the scan period to drive the first transistor and the second transistor to be turned on, and when the row of pixels in which the target pixel is located is selected, the first driving signal is at the first level within a third set time period and a fourth set time period in the sense period, wherein the first set time period is located between the third set time period and the fourth set time period.

8. The pixel circuit according to claim 7, further configured such that in a shutdown compensation phase, the second driving signal is at a second level to drive the fourth transistor to be turned off, wherein the second level is a low level.

9. The pixel circuit according to claim 8, wherein, in the shutdown compensation phase, when the row of pixels in which the target pixel is located is selected, the first driving signal is at the first level to drive the first transistor and the second transistor to be turned on.

10. The pixel circuit according to claim 1, configured such that in a shutdown compensation phase, the second driving signal is at a second level to drive the fourth transistor to be turned off, wherein the second level is a low level.

11. The pixel circuit according to claim 10, wherein, in the shutdown compensation phase, when the row of pixels in which the target pixel is located is selected, the first driving signal is at the first level to drive the first transistor and the second transistor to be turned on, wherein the first level is a high level.

12. The pixel circuit according to claim 1, wherein the light emitting unit is an organic light emitting diode or an active matrix organic light emitting diode.

13. The pixel circuit according to claim 1, wherein the first transistor, the second transistor, the third transistor, and the fourth transistor are thin film transistors.

14. The pixel circuit according to claim 1, wherein the first transistor, the second transistor, the third transistor, and the fourth transistor are N-type transistors.

15. A display panel, comprising the pixel circuit according to claim 1.

16. A display device, comprising a housing and the display panel according to claim 15.

* * * * *